United States Patent [19]

Salomon

[11] 4,159,124

[45] Jun. 26, 1979

[54] SAFETY BINDING FOR A SKI

[75] Inventor: Georges P. J. Salomon, Annecy, France

[73] Assignee: S.A. Etablissements Francois Salomon & Fils, Annecy, France

[21] Appl. No.: 864,227

[22] Filed: Dec. 27, 1977

[30] Foreign Application Priority Data

Dec. 30, 1976 [FR] France ..... 76 39568

[51] Int. Cl.[2] ..... A63C 9/08

[52] U.S. Cl. ..... 280/612

[58] Field of Search ..... 280/612; 335/234, 222

[56] References Cited

U.S. PATENT DOCUMENTS

| | | | |
|---|---|---|---|
| 3,367,672 | 2/1968 | Tonozzi et al. | 280/612 |
| 3,528,672 | 9/1970 | Wunder | 280/612 |
| 3,762,735 | 10/1973 | Smolka | 280/612 |
| 3,869,930 | 3/1975 | Forest | 335/222 X |
| 3,907,316 | 9/1975 | Marker et al. | 280/612 |

*Primary Examiner*—Joseph F. Peters, Jr.
*Assistant Examiner*—Milton L. Smith
*Attorney, Agent, or Firm*—Haseltine, Lake & Waters

[57] ABSTRACT

A ski binding having a locking device tripped electromechanically.

The device includes an electromagnetic circuit comprising means producing a permanent magnetic field and a winding able to move in said field, the winding being connected to a member for retaining the locking member in order to move the retaining member into an unlocked position when a current is established or interrupted in the winding.

9 Claims, 8 Drawing Figures

FIG.2
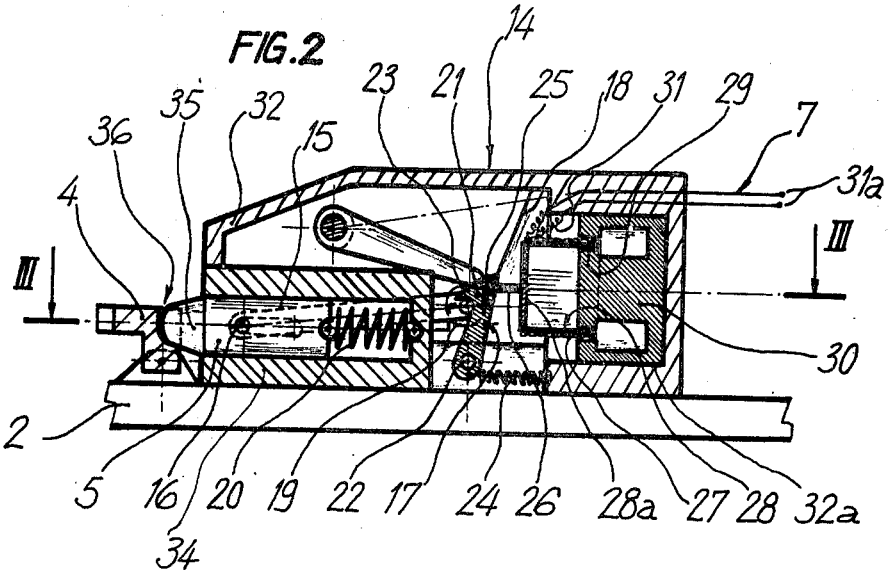
FIG.3
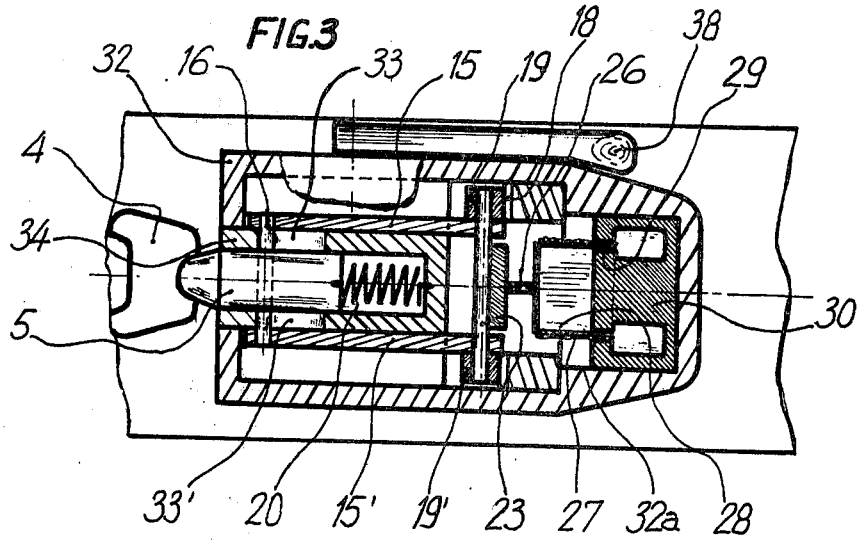
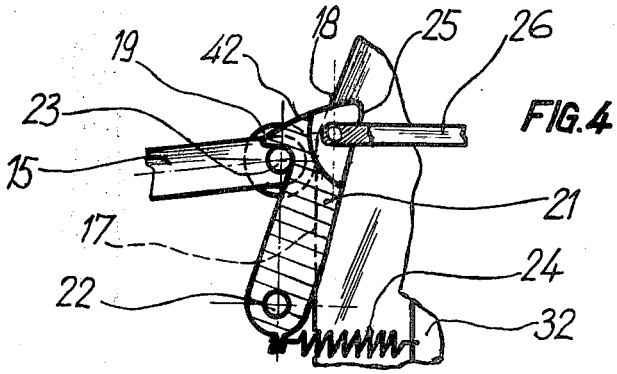
FIG.4

SAFETY BINDING FOR A SKI

The present invention relates to a safety binding for a ski, the tripping of which for the release of the boot is controlled by a signal coming from an electrical circuit, this binding comprising a locking device which is tripped electromechanically.

Safety bindings for skis are already known, comprising one or more electrical circuits, in particular a detection or pick-up circuit, a calculation circuit and tripping circuit. In this type of binding, this pick-up circuit detects stresses due to skiing, then a calculation is carried out by the calculation circuit which emits or does not emit a command sent to the tripping circuit which releases or does not release a locking member depending on the level of stress detected and possibly the duration of application of this stress.

In order to obtain optimum safety for the skier when skiing, in the case of dangerous falls, it is necessary that the connection between a skier's legs and the skis can be removed such that the dangers of fractures and injuries are reduced to the maximum extent. In fact, if the connection of the boot and ski were maintained for example, the enormous forces which occur at this time would cause such tensions in the skier's limbs that breakage of the latter would be inevitable. In this case, it is of prime importance that the release of the safety bindings is able to take place as rapidly as possible.

Bindings exist whose opening is controlled electrically or electronically. For releasing these bindings, certain arrangements have already been proposed and comprise either tripping devices controlled electromagnetically, constituted by a solenoid in which a core acting on a retaining member moves, or tripping devices comprising a rotary electric motor. Each of these arrangements has the drawback of having a very long response time between the command to trip the binding and the effective release of the latter.

Conventional electromagnets used in this type of binding comprise at least one fixed winding and a movable core, the latter moving in order to unlock a retaining member. However, electromagnets have response times which are much too long with respect to the durations of certain pulses which are detected by the circuit for detecting stress. This is due mainly to the fact that firstly the moving mass of the core is considerable and therefore has great inertia to movements and secondly the magnetization of the soft iron composing the core is a slow phenomenon. The consequence of this is that a certain delay is observed between the time when the tripping command is given and the time when the release is effective. Also it is to be feared that when the tripping command is given subsequent to an impact on the ski, the presence of too great a delay causes lesions in the skier's leg.

For bindings tripped by a rotary electrical motor, the connection between the shaft of the motor and the locking member is obtained by a pulling strap wound at one end on said shaft and at the other end attached to the locking member.

Just like electromagnets, the rotary electric motor has various drawbacks.

In the first place, the response time between the instant when the electrical pulse is supplied to the latter and the time when the shaft begins to rotate is too long.

In the second place, the flexibility and elasticity of the strap necessary for its correct winding on the shaft increase the response time further due to the resilient connection, at the time of the transmission of the rotary movement of the shaft to the movement of the locking member.

In addition, it should be noted that for these various bindings, unlocking takes place solely after the tripping device has overcome the resistance of a main spring, generally a compression spring, the consequence of which is to require a considerable consumption of energy for small movements of the locking members and hence to have a certain reaction delay (the time for accumulating the necessary energy).

The present invention intends to remedy the drawbacks inherent in currently known safety bindings of this type, by providing a particularly advantageous arrangement of a tripping device.

The device according to the invention intends to reduce to the minimum the response time between the electronic command (given at the time of an impact on a ski) and the release of the skier's leg. In fact, it is important that the time lapse between the instant when the enormous force (due to an impact) occurs and the instant when the binding releases the skier's leg is reduced to the minimum possible time, in order to eliminate the danger of accidents.

To this end, this safety binding for a ski, comprising a locking device tripped electromechanically, having a locking member able to move between two positions, namely a locking and unlocking position and an electromagnetic circuit acting directly or indirectly on this locking member in order to move it from its locked position into its unlocked position, is characterised in that the electromagnetic circuit comprises means producing a permanent magnetic field and a winding able to move by translation in this field and connected to the member for retaining a locking member for moving the latter into the unlocked position when a current is established (or interrupted) in this winding.

This tripping device is coupled with a particularly advantageous arrangement of the mechanical members, which in the case of the binding according to the invention means that the locking member is always biased towards the open position and in the position of use is solely prevented from so doing by a retaining member which ensures the equilibrium of the forces occurring.

In the case where a current is established in the winding, an additional advantage resides in the fact that biasing the locking member towards the open position requires only a low consumption of current to overcome the force of the return spring of the retaining member and this is only at the time of the tripping operations.

This embodiment makes it possible to obtain the desired tripping speed owing to the reduction in the response time which is due to the fact that the mass of the winding is slight, hence low inertia of said winding to movements and that the appearance of the force of magnetic attraction is instantaneous since it is linked to the sole time of establishing an electrical current in the same winding and not to the time of magnetization of the iron by means of a winding, since the presence of a permanent magnet ensures the continuous presence of a magnetic field.

Consequently, the continuous presence of the magnetic field in the fixed core also provides an appreciable saving in time in the response time which is increased further by the mechanical system of biasing the locking member towards the open position.

According to a preferred embodiment of the invention, a tripping device is fitted on a safety binding for a ski of the type comprising a locking unit for a ski boot or binding, which is normal or comprises a plate, or a support for a ski boot.

This tripping device comprises a coil whose support ensures sliding on a fixed core provided by a permanent magnet. The air gap of this permanent magnet corresponds to the opening for the passage of the cylinder comprised by the coil on its support. The support for the coil is connected to a retaining member by means of a connecting link.

This retaining member co-operates with a member for maintaining a locking member which in turn co-operates with the corresponding means for retaining a boot, boot support, binding or plate binding.

Various embodiments of the present invention will be described hereafter, as non-limiting examples, with reference to the accompanying drawings.

FIG. 2 is an axial and vertical sectional view of a locking unit, constructed according to the invention, in the locked position.

FIG. 3 is a horizontal sectional view taken on line III—III of FIG. 2.

FIG. 4 is a detailed view to an enlarged scale showing the attachment of the retaining member on the pin for engaging the maintaining links ensuring the closed position of use.

Figure 1:
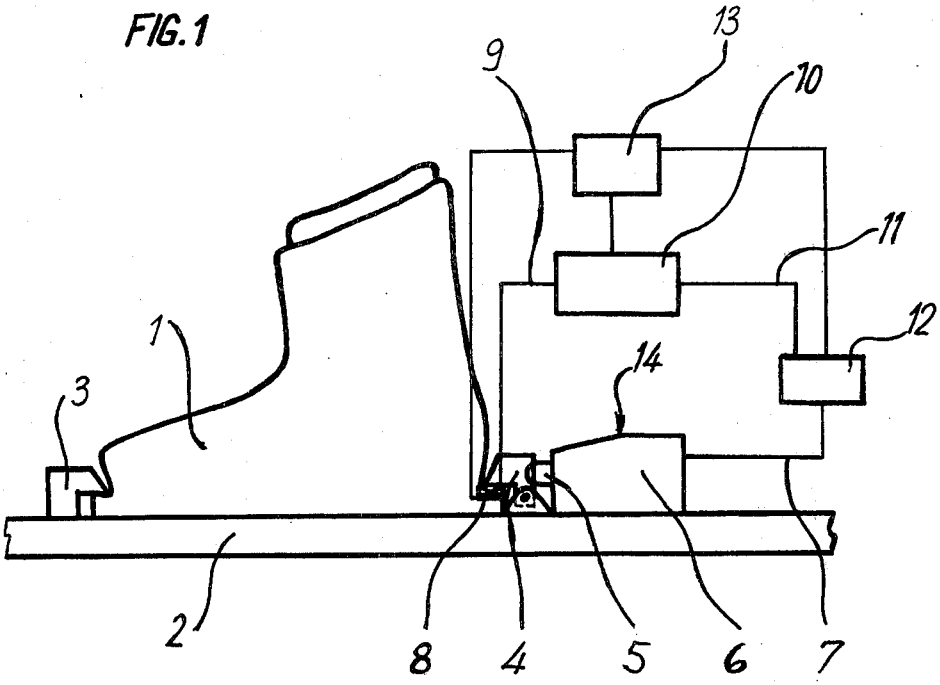
FIG. 1 is a diagram of a safety binding using a locking unit according to the invention.

FIG. 1 shows a boot 1 securely retained on a ski 2 by a front retaining member 3 and a rear retaining member 4. The latter is locked for skiing by a locking member 5. At the time of tripping, the member 5 is released by virtue of a tripping circuit 6 which is controlled by an electrical signal on a lead 7. The detection of stress to which the skier's leg is subjected is carried out by a circuit 8 which transmits a signal via a lead 9 to a calculation circuit 10. If the stress is not admissible and in particular exceeds a certain level, the circuit 10 in turn sends a signal via a lead 11 to a control circuit 12. A power supply 13 is provided for the detection circuit 8, calculation circuit 10 and control circuit 12. The control circuit sends an electrical signal via the lead 7 to the tripping circuit, which signal may be obtained for example by the discharge of a capacitor. The locking unit 14 comprising the locking member 5 and the tripping circuit 6 may be used for any other type of bindings tripped electrically. The locking member for example could co-operate directly with a boot or boot support.

One embodiment of the locking unit 14 according to the invention will now be described with particular reference to FIGS. 2, 3 and 4. This locking unit which is mounted on the ski 2 comprises the locking member 5 shown in the position locked on the member 4 for retaining the ski boot which is not shown.

The locking unit 14 comprises a casing 32 containing a longitudinal body 34 in which the locking member 5 is mounted to slide axially. This body 34 is engaged in an opening provided in the front side of the casing 32 and the front end of the locking member 5 projects outside the casing 32 at this point. The locking member 5 is biased rearwards, in the body 34, by a spring 20 housed between this member and the base of the body 34.

The locking member 14 is held in its position for use for skiing by means of two maintaining links 15, 15' extending substantially longitudinally on either side of the body 34. These links 15, 15' co-operate with the locking member 5 by means of a transverse pivot 16 connecting the front end parts of the two links 15, 15', while passing through longitudinal openings 33, 33' provided in the side walls of the body 34 and through a diametral hole provided in the locking member 5. The rear end parts of the links 15, 15' are interconnected by a transverse shaft 23 also forming an engagement pin and on the ends of which respective rollers 19, 19' located outside the links 15, 15' are mounted to rotate. These rollers and consequently the links 15, 15' are pressed under the action of the return spring 20 against the vertical lower part 17 of a ramp 18 whose upper part may be inclined upwards and towards the rear as shown in FIGS. 2 and 4, or even horizontally.

When the locking unit 14 is kept in the position locked on the retaining member 4, the two maintaining links 15, 15' are inclined slightly upwards and towards the rear, bearing against the lower vertical part 17 of the ramp 18 and they are held in this position by a retaining member 21 forming a pawl, which is pivoted at its lower part about a horizontal and transverse pivot 22. The upper part of the retaining member 21, in the form of a hook, is in mesh with the transverse shaft 23 forming the engagement pin between the links 15 and 15'. An additional return spring 24, which is under tension, is attached to a part of the casing 32 and to a lug provided on the lower part of the retaining member 21, in order that the latter is constantly biased in counter-clockwise direction in FIGS. 2 and 4. The return spring 24 thus contributes to keeping the member 21 in the retained position.

In its upper part, the retaining member 21 comprises a pivot 25 on which a traction rod 26 is engaged, which is controlled by the tripping device according to the invention. This tripping device comprises an electromagnet having a movable winding and more particularly a movable arrangement constituted by a support 28 of light material, such as aluminum, plastics material or the like, of tubular shape and outside which a winding 27 is mounted. The support 28 comprises a front cheek 28*a* to which one end of the traction rod 26 is connected. The electrical tripping circuit also comprises a stationary permanent magnet 30 which is located in a housing 32*a* provided in the rear part of the casing 32 of the locking unit 14. This magnet of cylindrical shape has a diametral section in the shape of a C having a central part 29 of T-shape in order to define a cylindrical air-gap in which the winding 27 may slide. This winding is connected by a flexible and extensible electrical cable 31 to a calculation circuit of which only the terminals 31*a* are shown.

It will be noted that in the position for use, the links 15, 15' provide a toggle closure device by means of the rollers 19, 19' bearing on the vertical part 17 of the ramp 18 and by the co-operation of the retaining member 21 with the engagement pin 23 ensuring the connection between said links. In this case, the function of the retaining member 21 is to retain the links at the dead center of the toggle closure device and consequently to provide locking in the position for use.

After a command given by the calculation circuit (not shown), a current is established in the turns of the winding 27 and this current, combined with the permanent magnetic field, creates a force proportional to the two, which causes a faster movement the smaller the mass of the winding 27 and its support 28, the permanent magnet being fixed in the casing 32 of the locking unit 14. The speed of the tripping operation may be increased further by the addition of a system of springs (or resilient system) 43 located for example below the links 15, 15' and acting by compression, the effect of which is to cause the removal of said links from the dead center of the toggle at the time of the tripping of the retaining member 21.

Figure 5:
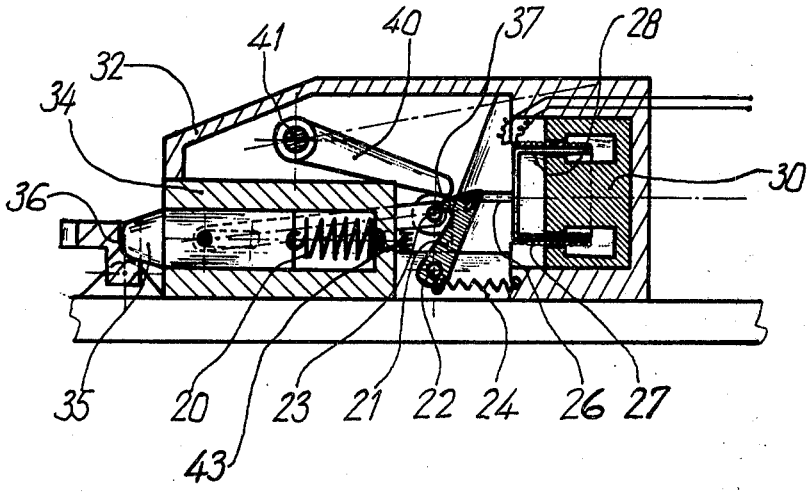
FIG. 5 is an axial and vertical sectional view of the locking unit in which the tripping pawl is shown at the given instant "t" when tripping occurs.

The traction force created at the time of the above-described phenomenon thus cancels out the frictional forces in the region of the co-operation of the retaining member 21 and engagement pin 23 as well as the traction force of the return spring 24. The translation of the winding 27 sliding on the central part 29 of the magnet 30 is directly transmitted by the traction rod 26 to the retaining member 21 which thus pivots in clockwise direction eliminating the engagement of the engagement pin 23 (FIG. 5).

Figure 6:
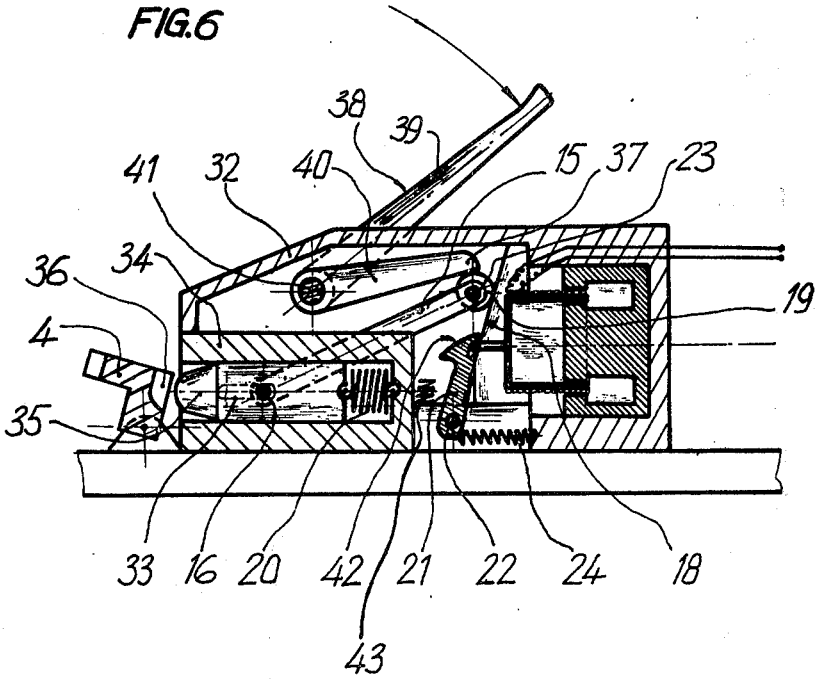
FIG. 6 is an axial and vertical sectional view of the locking unit shown in the tripped position.

FIG. 6 shows the locking unit 14 in its unlocked position. Since the engagement pin 23 is released from the retaining member 21, the action of the return spring 20 is immediate and the effect of the latter is to exert a pulling force on the locking member 5 which moves back, thus modifying the position of the pivot 16 which slides in apertures 33, 33' provided for this purpose in the body 34 of the locking member 5 and releasing the front conical part 35 of the housing 36 from co-operation with the retaining member 4. The links 15, 15' which are pivoted on the locking member 5 by the pivot 16, move along the ramp 18 facilitated by the rollers 19, 19' which assist the movement by better rolling.

The links 15, 15' thus pivot about the front pivot 16 in counter-clockwise direction, corresponding to an ascending movement of the rollers 19, 19' on the ramp 18.

For re-setting the safety binding, the latter is provided with a re-setting lever 38 comprising at least one side 39 located outside the casing 32 and at least one side 40 located inside this casing, these two sides forming therebetween a certain angle for facilitating the operation. The two sides 30 and 40 are integral with a horizontal and transverse pivot 41, which is mounted to pivot in at least one of the lateral and vertical walls of the casing 32 through which it passes. The inner side 40 of the re-setting lever 38 co-operates with one of the rollers, for example the roller 19, by its end 37 bearing on this roller.

In the inoperative position, i.e. when the binding has been tripped (FIG. 6), the rollers 19, 19' are in the upper position on the ramp 18 and the same is true for the lever 38 and more particularly its outer side 39. For re-setting the locking unit, the skier thus presses on the outer side 39 of the re-setting lever 38 in order to pivot this lever in clockwise direction, in FIG. 6. The pivotal movement is transmitted to the inner side 40 which thus presses on the roller 19 in order to push the latter down while rolling on the ramp 18. Consequently, the link 15 tends to be flattened and it is in turn pushed forwards, thus entraining the locking member 5 in this same direction, hence tensioning the return spring 20. During the descending movement of the link 15, the retaining member 21 is located in its initial position, to which it was restored at the time of the interruption of the electrical current and this is under the action of the return spring 24 whose force is clearly less than that of the spring 20. Consequently, at the time of the descending movement of the rear end of the link 15, the transverse shaft 23 forming the engagement pin slides on the upper profile 42 of the retaining member 21, thus causing this retaining member to pivot slightly in clockwise direction against the action of the return spring 24. Then, the upper part forming a hook of the retaining member 21 is returned above the engagement pin 23, under the action of the spring 24, in order to ensure locking of this pin. The engagement is thus ensured by the permanent tension of the spring 24. When the co-operation of the engagement pin 23 and retaining member 21 has been established, locking of the entire device is once more ensured.

Clearly, the invention is in no way limited to the embodiment described and illustrated, which was given solely as an example. The invention may be modified as regards the arrangement of the various members. A locking device may be provided whose winding, in the position for use, permanently receives a current whose interruption causes tripping of the device. In this case, the return spring 24 is advantageously replaced by a compression spring which restores the retaining member 21 to its engagement position.

The device according to the invention could be used for all types of ski bindings without diverging from the framework of the invention.

Figure 7:
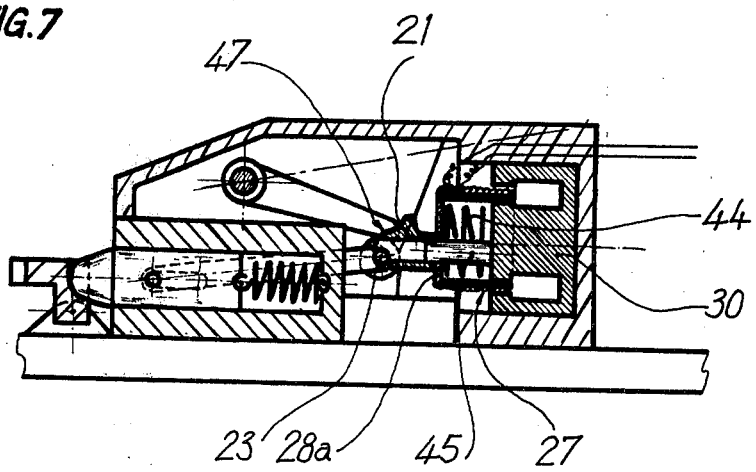
FIG. 7 is an axial and vertical sectional view of a locking unit constructed according to a variation of the invention, in the locking position and where the tripping pawl acts by translation.
Figure 8:
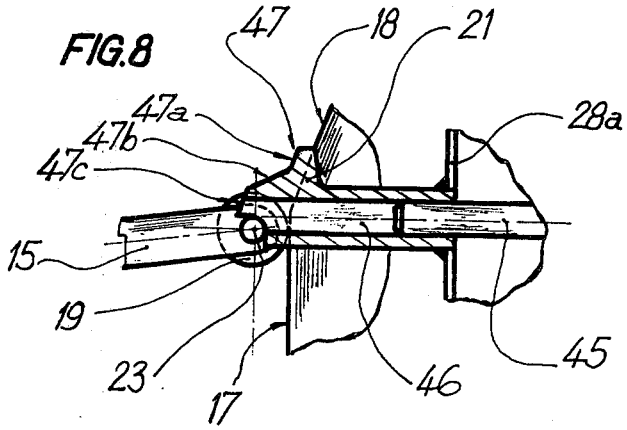
FIG. 8 is a detailed view, to an enlarged scale, showing the engagement of the retaining member, according to the variation of FIG. 7, on the pin for engaging the maintaining links ensuring the closed position of use.

According to another variation (FIGS. 7 and 8) the retaining member 21 may be able to move by translation instead of being pivotally mounted, as indicated in the example described previously. In this case, the retaining member 21 may be formed with an upper profile 47 facilitating re-setting from the unlocked position to the locked position. To facilitate the translational movements, this retaining member 21 is constructed at the end of a sliding rod 46 integral with the moving arrangement (28, 28*a*), in which guide means 45 are fitted, which are stationary with respect to said moving arrangement comprising the winding 27. This moving arrangement is permanently biased by a compression spring 44 whose action is the opposite of the electromagnetic action which is exerted on the moving arrangement when the winding 27 receives a current. To facilitate re-setting, it will be noted that the profile 47 is provided in an arcuate manner. In fact, the translational movement requires a well-defined travel of the sliding member (21, 46), with respect to the ramp 18, thus the profile 47 is divided into three portions 47*a*, 47*b*, 47*c*. The portion 47*a* is characterised by the fact that it is parallel to the inclination of the ramp 18, at a distance equal to the difference in the radii of the pin 23 and roller 19, such that the pin 23 begins the movement of withdrawal from the pawl 21 correctly which takes place when the pin 23 arrives on the portion 47*b* and is completed when it reaches the bottom of the portion 47*c*. At this instant, the pin engages under the member 21 which is pushed forwards by the spring 44. Also, in this case, it is apparent that the spring 44 has a force clearly less than that of the spring 20.

What is claimed is:

1. A ski safety binding comprising an electromechanically tripped locking device, the locking device comprising a locking member movable between locked and unlocked positions, a resilient member permanently biasing said locking member towards said unlocked position, a pawl mounted to pivot about a transverse pivot with respect to the ski and constituting a member for retaining said locking member, a maintaining member connected with said locking member, an engagement pin integral with said maintaining member and co-operating with said pivoting pawl, a spring permanently biasing said pawl to pivot in the direction of said engagement pin in order to keep said locking member in said locked position, an electromagnetic circuit comprising means producing a permanent magnetic field, a coil movable in said field along a substantially longitudinal axis with respect to said ski, and a connecting rod connecting said coil to said pivoting pawl, whereby said locking member may be moved to said unlocked position by controlling current in said winding.

2. A ski safety binding according to claim 1, in which said maintaining member is constituted by links mounted to rotate on said locking member.

3. A ski safety binding according to claim 1, in which said maintaining member constitutes, with said retaining member, a closing device of the toggle type.

4. A ski safety binding according to claim 3, comprising at least one connecting link constituting said maintaining member connected at its front end to said locking member, a body in which said locking member is mounted to slide, a ramp comprising a lower vertical part and an upper/part inclined upwards and rearwards, said connecting link being pressed, at its rear end, against the lower vertical part of said ramp, said connecting link supporting said engagement pin co-operating with said pivoting pawl when said locking member is in said locked position and being inclined slightly upwards and towards the rear.

5. A ski safety binding according to claim 4, comprising two such connecting links constituting said maintaining member and arranged respectively on either side of said body in which said locking member slides, a first transverse pivot passing through said locking member and connecting the front ends of said two links, two opposing longitudinal apertures provided in the walls of said body and through which said first transverse pivot passes, a second transverse pivot connecting the rear parts of said two links and constituting said engagement pin for said pivoting pawl, and rollers mounted at the ends of said second transverse pivot and rolling on the lower part of said ramp.

6. A ski safety binding according to claim 5, comprising at least one spring tending to raise said connecting links.

7. A ski safety binding according to claim 1, comprising re-setting means for returning said locking member from said unlocked position to said locked position.

8. A ski safety binding according to claim 7, in which said re-setting means comprise a transverse pivot and a lever mounted to turn about said transverse pivot and comprising one side acting on said maintaining member connected to said locking member.

9. A ski safety binding according to claim 8, comprising a casing containing the entire mechanism of the device and on which said lever is pivoted, said lever comprising a first side located outside said casing and able to be actuated manually and a second side located inside said casing, said second inner side bearing, at its end, on said engagement pin integral with said maintaining member.

* * * * *